United States Patent [19]

Jones et al.

[11] 4,443,967

[45] Apr. 24, 1984

[54] FLYWHEEL DRIVEN TOY CAR

[75] Inventors: Lawrence T. Jones, Playa Del Rey; Anson Sims, Granada Hills; Ashley G. Howden, Los Angeles, all of Calif.

[73] Assignee: California R & D, Culver City, Calif.

[21] Appl. No.: 348,301

[22] Filed: Feb. 12, 1982

[51] Int. Cl.[3] ..... A63H 29/20

[52] U.S. Cl. ..... 46/209

[58] Field of Search ..... 46/206, 207, 208, 209, 46/201, 202

[56] References Cited

U.S. PATENT DOCUMENTS

| | | | |
|---|---|---|---|
| 806,977 | 12/1905 | Kingsbury . | |
| 2,731,765 | 1/1956 | Carver . | |
| 2,873,553 | 2/1959 | Ullman . | |
| 3,621,607 | 11/1971 | Morrison et al. | 46/206 |
| 3,932,957 | 1/1976 | Morrison et al. | 46/206 |
| 3,955,429 | 5/1975 | Holden . | |
| 4,130,963 | 12/1978 | Ohashi . | |
| 4,192,093 | 3/1980 | Hamano | 46/206 X |
| 4,283,879 | 8/1981 | Tsui . | |

FOREIGN PATENT DOCUMENTS

| | | | |
|---|---|---|---|
| 960859 | 1/1975 | Canada | 46/206 |

*Primary Examiner*—Mickey Yu

*Attorney, Agent, or Firm*—Jackson, Jones & Price

[57] ABSTRACT

A toy vehicle is provided that can be manually activated to store kinetic energy. The rear wheels of the vehicle can be positioned so that upon tilting and movement of the vehicle, a gear assembly provides a high gear ratio to rotate a flywheel held off of the support surface. Subsequently, upon release of the toy vehicle, the contact of the flywheel with a support surface drives the car with the rear wheels held off of the support surface.

12 Claims, 4 Drawing Figures

FIG 1
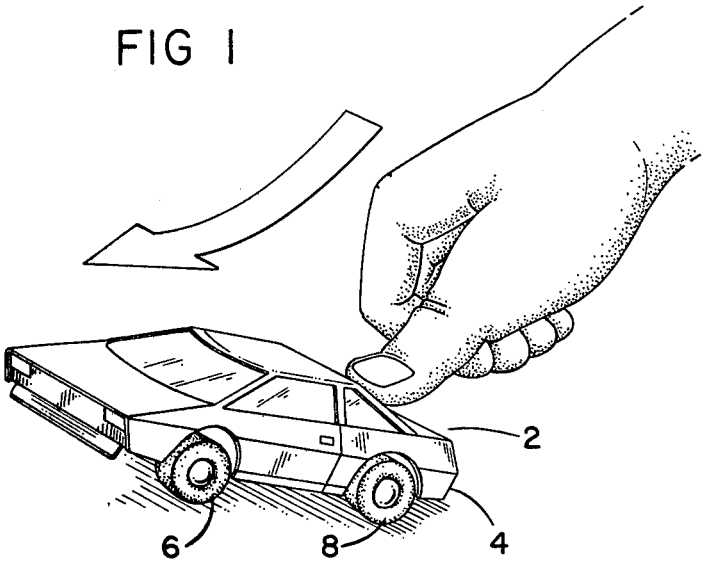
FIG. 2
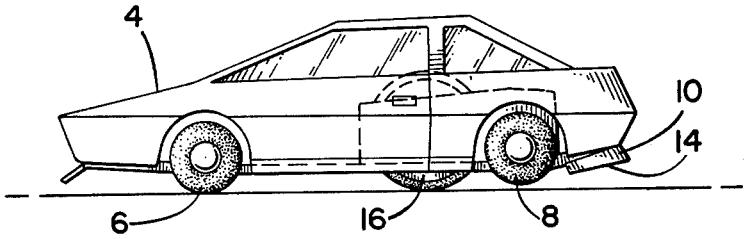
FIG. 3
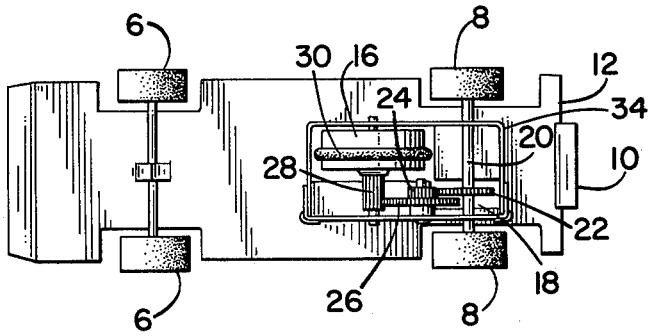
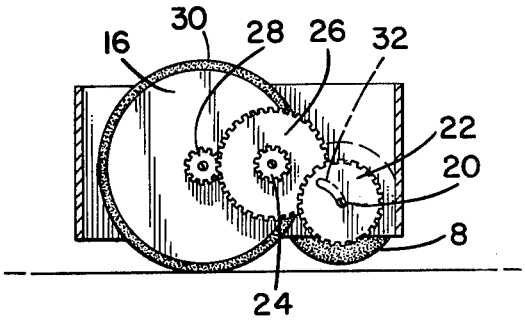
FIG. 4

FLYWHEEL DRIVEN TOY CAR

BACKGROUND OF THE INVENTION

1. Field of the Invention

The present invention is directed to the toy industry, and more particularly to a toy vehicle with improved acceleration capabilities.

2. Description of the Prior Art

The toy industry has provided a large number of variously designed mobile toys for use by children. Toy vehicles have been a frequent and popular toy for young children and frequently incorporate mechanical or frictional drive systems for moving the toy vehicle. In this regard, accessory appendages such as gears, levers, and racks have been utilized to accelerate a flywheel, mounted in the toy vehicle, to store kinetic energy for driving the toy vehicle. The toy vehicle is then usually referred to permit engagement of the driving gear wheels with a support surface for acceleration of the toy vehicle. Generally, toy vehicles have utilized an internal flywheel that is either mounted horizontally or vertically and is connected by a gear train to the rear wheel assembly. By repetitive translation of the toy vehicle and the rear wheels across a support surface, kinetic energy is stored in the flywheel and then is utilized by releasing the toy vehicle for driving by the same rear wheels that had stored up the energy. While numerous different toy vehicle structures and designs have been suggested and in fact utilized by the toy industry, the industry is still receptive to innovative toy vehicles that can provide improved performance for the appreciation of a child.

SUMMARY OF THE INVENTION

The present invention provides a toy vehicle having a subjectively configured frame and body housing to asthetically appeal to the child. The front wheels can be mounted for free rotation to permit the vehicle body to translate across a support surface. The rear wheels can be connected through a gear assembly to a rotable driving member that can also act as the flywheel for storing kinetic energy. In one embodiment of the present invention, the rear wheels are directly connected to the gear assembly with the flywheel. The flywheel is of such a dimension that when mounted about a horizontal axis, the flywheel directly contacts the support surface for providing the translational driving movement. In this embodiment the rear wheels are positioned above the support surface during a driving translational movement. Thus, the vehicle body is rotated so that the rear wheels come into contact with the support surface only during an initial movement wherein kinetic energy is introduced into and stored in the rotational movement of the flywheel. To facilitate this initial movement, a skid or guide member can be positioned to provide the proper angular orientation of the rear wheel and the support surface via the flywheel. That is, the flywheel is positioned out of contact with the support surface when the guide member and the rear wheel are held in moving contact with the support surface.

An alternative embodiment of the present invention permits a relative movement of the rear wheel assembly so that it can be released from the gear assembly and becomes passive during the driving translational movement by the flywheel.

While the present invention utilizes the rear wheel assembly as a passive member during a driving translational movement since it is more convenient for a child to tilt the car body so that the front of the vehicle rotates upward to simulate, for example, a "wheelie" movement, it should be recognized that the same principles of the present invention could be utilized with the front wheel assembly serving the same function as the rear wheel assembly.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a side elevated perspective view of the present invention;

FIG. 2 is a side view of the present invention;

FIG. 3 is a plan view of the present invention showing the frame and transmission assembly without the vehicle body; and FIG. 4 is a schematic partial side view of an alternative embodiment of the present invention.

DESCRIPTION OF THE PREFERRED EMBODIMENTS

The following descriptions are provided to enable any persons skilled in the toy industry to make and use the invention and it sets forth the best modes contemplated by the inventors of carrying out their invention. Various modifications, however, will remain readily apparent to those skilled in the toy industry, since the generic principles of the present invention have been defined herein specifically to provide a relatively economical and easily manufactured toy vehicle assembly.

Referring to FIG. 1, a child is shown manually accelerating one embodiment of the present invention in the form of the two-door sedan toy vehicle 2. The specific configuration of the vehicle body is, of course, subjectively determined and it is contemplated that the toy vehicle can be sold as a line of toy vehicles with different body configurations in the commercial market. As can be further seen from FIG. 1, the child presses down on the rear upper surface of the rear body 4 of the toy vehicle 2 which will elevate the front wheel assembly 6 or support means off of the support surface. The rear wheel assembly 8 is then positioned in a driving engagement with the support surface. This angular position of the toy vehicle 2 is preferably maintained by the provision of a guide member or skid member 10 that is attached adjacent the rear of the frame member 12. The guide member 10, disclosed in FIG. 2, can be made from Teflon having an inclined guiding surface 14 that is juxtapositioned relative to the contact surface of the rear wheel assembly to ensure a sufficient rotation of the toy vehicle 2 to position a flywheel member 16 away from the support surface during an initial enegerization of the flywheel 16.

A gear train assembly 18, shown in FIG. 3, interconnects an axle 20 of the rear wheel assembly 8 with the flywheel 16. A drive gear 22 on the axle 20 engages a pinion gear 24 which in turn is fixedly mounted on a common rotational shaft with a second drive gear 26 that interfaces with a second pinion gear 28. The second pinion gear 28 is fixedly mounted on the same rotable shaft that supports the flywheel member 16. The flywheel member 16 can be further provided with a friction tire or gasket 30 to assist in driving the vehicle assembly during the translational movement of the vehicle 2. The flywheel member 16 can have an annular groove for receiving and maintaining the friction tire 30.

The guiding surface 14 is normally inclined to the horizontal support surface during the translational movement of the vehicle 2 and the specific angular inclination is such that when the guide surface 14 is placed adjacent and parallel to the support surface, the driving flywheel 16 is disengaged from the same support surface. As can be readily appreciated, the guiding surface 14 could be replaced, for example, by a fifth wheel member or a rotating cylinder. However, for an economical manufacturing of the toy vehicle, a relatively low-friction surface of a metal or plastic plate can be adequately used to achieve the principles of the present invention.

The gear ratio that is provided by the gear train assembly 18 can be relatively high. For example, the ratio can be such that one rotation of the rear wheel assembly 8 will produce twelve rotations of the flywheel member 16 thereby providing a gear ratio of one to twelve (1:12). With this high gear ratio, the resulting speed capabilities of the toy car assembly 2 is startlingly fast compared to the relatively low velocity used to accelerate the flywheel member 16. The storing of kinetic energy can also produce a turbine-like sound to further heighten the enjoyment of the child when playing with the toy.

The flywheel member 16 uses a relatively resilient friction gasket 30 or traction tire made out of, for example, rubber, neoprene or kraton and this friction tire 30 will contact the support surface or "road" along with the front wheel assembly 6 when the car is sitting in a normal stationary condition. This mode of operation is shown in FIG. 2, wherein a three-wheel balance is provided between the front wheel assembly 6 and the flywheel 16. When the child wishes to operate the toy car 2, the rear portion of the toy car 2 is tipped downward thereby lifting the front wheel assembly 6 and the flywheel member 16 off of the support surface. The flywheel member 16 is now free to rotate via the gear train assembly 18 when the toy vehicle 2 is pushed forward in this nosed-up position. One or more pushes on the ground or support floor will accelerate the flywheel member 16 to high rotational speed with a resulting storage of kinetic energy. The child then quickly releases the car at the end of its forward motion and the toy vehicle 2 will immediately accelerate as a result of the flywheel friction tire 30 contacting the support surface. Unlike other toy car power systems, the gear-driven flywheel member 16 is used as the driving road wheel while the normal-looking rear wheels are actually only used to wind up or store kinetic energy in the flywheel system. The rear wheel assembly 8 is sufficiently close to the ground to maintain an appearance of a normal car driving motion to the casual observer. A substantially higher speed and acceleration is achieved than would normally be the case if the rear wheel assembly 8 was also used to drive the toy car forward in addition to storing kinetic energy in the flywheel member 16. Thus, by a relatively novel and simple arrangement, a toy vehicle of startling acceleration capabilities is achieved to the surprise of the child.

A variation of the present invention can be achieved as disclosed in FIG. 4, wherein like elements are given the same reference numbers in the drawing. In this embodiment, it is desired to concave additional kinetic energy that is stored in the flywheel assembly 16 by releasing the first drive gear 22 from contact with the first pinion gear 24. When these respective gear members are out of contact, no energy will be used to drive the rear wheel assembly 8 and a higher percentage of the kinetic energy stored in the flywheel member 16 can be used to translate the toy vehicle 2 across the support surface. This can be accomplished by journaling the rear axle 20 in a pair of curved oblong slots 32 on either side of the support housing frame 34. In the view shown in FIG. 4, the axle 20 is positioned by gravity at the bottom portion of the oblong slots 32 and the drive gear 22 is held out of driving contact with the pinion gear 24. As a result, the rear wheel assembly 8 is essentially passive and does not needlessly dissipate any of the kinetic energy from the flywheel member 16. When it is desired, however, to accelerate the flywheel member 16, the toy vehicle 2 is again rotated as shown in FIG. 1 with the guiding support surface 14 being realigned to take into account the necessary rotation of the rear wheel axle 20 through the oblong slots 32 for engagement of the driving gear 22 with the pinion 24. Toy vehicle 2 is then moved forward at a relatively low velocity with the high gear ratio accelerating the flywheel member 16 to a relatively high number of revolutions per minute. When the child then releases the toy vehicle 2, the vehicle assumes the horizontal position shown in FIG. 2 and the rear wheel assembly 8 falls to the bottom of the oblong slots 32 as a result of gravity and assumes the position shown in FIG. 4. As can be readily appreciated, a biasing spring (not shown) could be utilized to ensure a positive disengagement of the driving gear 22 from the pinion gear 24. In summary, the rear axle 20 with its driving gear 22 is disengaged from the gear train assembly 18 when the flywheel member 16 is in driving contact with the support surface but will be engaged when it is rotated to the top of the slot 32 to permit the storing of kinetic energy in the flywheel member 16. As can be appreciated, during the translational movement of the vehicle at high acceleration the vehicle support is basically a tricycle arrangement with the front wheels and flywheel in contact with the support surface.

An alternative embodiment (not shown) could have the gear box pivotable about the rear axle with the vehicle body being spring biased so that the rear portion of the vehicle is positioned upward to lift the rear wheels off of the support surface while maintaining the flywheel in contact with the support surface. Pressing down on the rear of the car body would tilt the gear box about the axle to lift the flywheel clear of the support surface to permit acceleration of the flywheel through rotation of the rear wheel assembly. In this mode of operation, the front wheels and the rear wheels would be in contact with the support surface. When the child releases the vehicle the spring bias will return a now spinning flywheel member with the stored kinetic energy to contact the ground and will further lift the rear wheels off the ground. The vehicle then would be driven forward for translational movement again on three wheels; the flywheel and the front wheels.

Finally, it is quite possible to use a front wheel drive version of the toy vehicle system wherein the front wheels would power the flywheel member and then would be elevated off of the support surface during translational movement.

In summary, the present invention provides a novel toy car power system using a gear-driven flywheel arrangement that is capable of providing surprising acceleration for the toy vehicle upon a relatively slow velocity rev-up or wind-up stage of operation. As can be readily appreciated the toy can come in various dimensions and can be made from various types of material such as metal and plastic but is preferably of a dimension, shape and weight that can be operated by a child with one hand.

Since other modifications are possible by a person skilled in the toy industry, once given the generic principles of the present invention, the actual scope of the present invention should be determined solely from the claims wherein we claim.

We claim:

1. A toy vehicle comprising:

a frame member;

support means for supporting one end of the frame member during translation across a support surface;

drive means for driving the frame member in a translational movement including a rotatable flywheel member contacting the supporting surface during a driving translational movement;

means for manually introducing kinetic energy to the rotatable flywheel member during movement of the frame member while simultaneously disengaging its contact with the support surface during a preliminary energization movement whereby subsequent contact of the rotatable flywheel member with the support surface will drive the vehicle, including a rear wheel assembly and a gear train assembly interconnecting the rear wheel assembly with the flywheel member, the rear wheel assembly is mounted relative to the flywheel member so that it does not engage the support surface when the support means and rotatable flywheel member are both engaged with the support surface.

2. The invention of claim 1 wherein the support means includes a front wheel assembly.

3. The invention of claim 2 further including a second support member mounted relative to the frame so that when the rear wheels and second support member engage the support surface the driving flywheel is disengaged from the support surface during the preliminary energization movement.

4. The invention of claim 3 wherein the second support member includes a guide surface inclined to the horizontal during translational movement with such an angular inclination that when the guide surface is placed adjacent and parallel to the support surface, the drive means is disengaged from the support surface.

5. The invention of claim 1 wherein the flywheel further includes an annular friction member.

6. The invention of claim 1 wherein the rear wheel assembly includes an axle mounted for relative movement to the gear train assembly wherein the rear wheel assembly is only engaged with the gear train assembly during the preliminary energization movement.

7. A toy vehicle capable of translation across a support surface comprising:

a body member;

a front wheel assembly rotably attached to the body member;

a rear wheel assembly rotably attached to the body member;

a drive wheel means connected to the body member and contacting the support surface during translation;

a gear assembly interconnecting the drive wheel to the rear wheel assembly; and means to permit the disengagement of the drive wheel means from the support surface while rotating the rear wheel assembly to impart rotational energy to the drive wheel means.

8. The invention of claim 7 wherein the drive wheel means is mounted between the front wheel assembly and the rear wheel assembly and the rear wheel assembly is positioned above and out of contact with the support surface during translational movement.

9. A toy vehicle capable of independent translation across a support surface after an initial energization movement comprising:

a body member;

a front wheel assembly rotatably attached to the body member;

a rear wheel assembly rotatably attached to the body member;

a flywheel rotatably connected to the body member and contacting the support surface during translation;

a gear assembly interconnecting the flywheel to the rear wheel assembly; and means to permit the disengagement of the flywheel from the support surface while rotating the rear wheel assembly to impart rotational energy to the flywheel including a second support member mounted relative to the body member so that when the rear wheel assembly and second support member engage the support surface, the flywheel is disengaged from the support surface during the energization movement.

10. The invention of claim 9 wherein the second support member includes a guide surface inclined to the horizontal during translational movement with such an angular inclination that when the guide surface is placed adjacent and parallel to the support surface, the flywheel is disengaged from the support surface.

11. The invention of claim 9 wherein the flywheel further includes an annular friction member.

12. The invention of claim 10 wherein the rear wheel assembly includes an axle mounted for relative movement to the gear train assembly wherein the rear wheel assembly is only engaged with the gear train assembly during the energization movement.

* * * * *